US009579899B2

(12) United States Patent
Miyashita

(10) Patent No.: US 9,579,899 B2
(45) Date of Patent: Feb. 28, 2017

(54) INK JET RECORDING DEVICE, LIQUID SUPPLYING DEVICE, AND METHOD OF CONTROLLING INK JET RECORDING DEVICE

(71) Applicant: MIMAKI ENGINEERING CO., LTD., Nagano (JP)

(72) Inventor: Eiji Miyashita, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/434,101

(22) PCT Filed: Oct. 4, 2013

(86) PCT No.: PCT/JP2013/077066

§ 371 (c)(1),
(2) Date: Apr. 8, 2015

(87) PCT Pub. No.: WO2014/057878

PCT Pub. Date: Apr. 17, 2014

(65) Prior Publication Data

US 2015/0258797 A1 Sep. 17, 2015

(30) Foreign Application Priority Data

Oct. 12, 2012 (JP) ..... 2012-227386

(51) Int. Cl.
*B41J 2/175* (2006.01)

(52) U.S. Cl.
CPC ..... *B41J 2/175* (2013.01); *B41J 2/17509* (2013.01); *B41J 2/17513* (2013.01); *B41J 2/17523* (2013.01)

(58) Field of Classification Search
CPC .... B41J 2/175; B41J 2/17523; B41J 2/17513; B41J 2/17509
See application file for complete search history.

(56) References Cited

U.S. PATENT DOCUMENTS

2009/0009569 A1 1/2009 Sasaki
2011/0050817 A1 3/2011 Tamada et al.

FOREIGN PATENT DOCUMENTS

JP 2001-162825 6/2001
JP 2001-162831 6/2001
(Continued)

OTHER PUBLICATIONS

Machine translation of JP 2007-105929 A. (JP 2007-105929 A was published on Apr. 26, 2007.).*
(Continued)

*Primary Examiner* — Justin Seo
(74) *Attorney, Agent, or Firm* — Jianq Chyun IP Office

(57) ABSTRACT

A problem is aimed to provide a liquid supplying technique that can efficiently perform liquid filling by a compact configuration, and an ink jet recording technique that uses this technique. As a solution thereto, in a liquid supplying device (20), a part of a first liquid ejecting passage is arranged at a higher position than a liquid storage (22), a second liquid ejecting passage includes a variable passage resistor (29), and a second opening (24) leading to the second liquid ejecting passage at the liquid storage (22) is arranged at a higher position than a first opening (23) leading to the first liquid ejecting passage.

7 Claims, 7 Drawing Sheets

(56) References Cited

FOREIGN PATENT DOCUMENTS

| | | |
|---|---|---|
| JP | 2001-277544 | 10/2001 |
| JP | 2003-237108 | 8/2003 |
| JP | 3828327 | 10/2006 |
| JP | 2007-105929 | 4/2007 |
| JP | 2008-110599 | 5/2008 |
| JP | 2011-88354 | 5/2011 |

OTHER PUBLICATIONS

"International Search Report (Form PCT/ISA/210)", mailed on Oct. 29, 2013, with English translation thereof, pp. 1-4.
"1st Office Action of China Counterpart Application", with English translation thereof, issued on Oct. 29, 2015, p. 1-p. 13.
"Search Report of European Counterpart Application", issued on Dec. 17, 2015, p.1-p.10.
"Office Action of China Counterpart Application" with English translation, issued on Jun. 3, 2016, p. 1-p. 10.
"Office Action of Japan Counterpart Application" with English translation, issued on Jul. 5, 2016, p. 1-p. 5.

* cited by examiner

INK JET RECORDING DEVICE, LIQUID SUPPLYING DEVICE, AND METHOD OF CONTROLLING INK JET RECORDING DEVICE

CROSS-REFERENCE TO RELATED APPLICATION

This application is a 371 application of the International PCT application serial no. PCT/JP2013/077066, filed on Oct. 4, 2013, which claims the priority benefit of Japan application no. 2012-227386, filed on Oct. 12, 2012. The entirety of each of the above-mentioned patent applications is hereby incorporated by reference herein and made a part of this specification.

TECHNICAL FIELD

The present invention relates to an ink jet recording device, a liquid supplying device, and a method of controlling the ink jet recording device.

BACKGROUND ART

Patent Document 1 describes an ink jet recording device that includes a recording head that discharges liquid droplets, and a liquid container which stores liquid to be supplied to the recording head and to which the liquid is supplied from a main cartridge, wherein the liquid container includes an opening and closing driving unit having a space for sealing an opening of a container body having the opening by a member with flexibility to house the liquid therein, and having a member for outwardly biasing the member with flexibility in the space, where the container body is provided with an atmosphere opened port for opening the space to atmosphere and with an atmosphere opening valve that opens and closes the atmosphere opened port, and the opening and closing driving unit driving the atmosphere opening valve of the liquid container to open and close; and a control unit that performs control of atmosphere opened filling that drives the opening and closing driving unit to bring the atmosphere opening valve to be in an opened state to supply liquid from the main cartridge to the liquid container, and atmosphere non-opened filling that brings the atmosphere opening valve to be in a closed state to supply liquid from the main cartridge to the liquid container, wherein the control unit performs the atmosphere opened filling when the main cartridge is replaced.

PRIOR ART DOCUMENT

Patent Document

Patent Document 1: JP 2003-237108 A (published on Aug. 27, 2003)

SUMMARY OF THE INVENTION

Problem to be Solved by the Invention

As in the technique described in Patent Document 1, at the time of filling liquid (ink) in an ink jet recording device that opens the atmosphere opening valve to fill the liquid in the liquid container, there is a possibility that the liquid may leak from a passage that passes through the atmosphere opening valve during the filling. To prevent this, Patent Document 1 describes a configuration in which a detection pin for measuring a resistance value of an upper part of the liquid container is provided, and liquid filling is performed while confirming presence or absence of the liquid in the upper part of the liquid container based on a measured result from the detection pin. However, such a structure and a control method become complicated for such a configuration, which may become a cause of cost increase.

The present invention has been made in view of the above problem, and is aimed primarily to provide a liquid supplying technique that can efficiently perform liquid filling with a compact configuration, and an ink jet recording technique that uses this technique.

Solutions to the Problem

To solve the above problem, an ink jet recording device according to the present invention includes: a recording head including a nozzle that discharges liquid droplets; a liquid storage that stores liquid to be supplied to the recording head; a first liquid ejecting passage that supplies the liquid from the liquid storage to the recording head; and a second liquid ejecting passage that supplies the liquid from the liquid storage to the recording head by a passage different from the first liquid ejecting passage; wherein a part of the first liquid ejecting passage is arranged at a higher position in a direction of gravity than the liquid storage, the second liquid ejecting passage includes a variable passage resistor having a passage resistance which is variable, and the liquid storage includes a first opening leading to the first liquid ejecting passage, and a second opening arranged at a higher position in the direction of gravity than the first opening and leading to the second liquid ejecting passage.

According to the above configuration, in the liquid storage, the second opening leading to the second liquid ejecting passage is arranged at the higher position than the first opening leading to the first liquid ejecting passage.

Due to this, at the time of filling the liquid in the liquid storage, air in the liquid storage can be deaerated through the second liquid ejecting passage while filling the liquid in the liquid storage and the first liquid ejecting passage.

Further, since a part of the first liquid ejecting passage is arranged at the higher position than the liquid storage, a circumstance in which only the liquid is taken out through the first liquid ejecting passage before the air in the liquid storage is sufficiently deaerated through the second liquid ejecting passage can be avoided.

According to this, the liquid can be smoothly filled in the liquid storage.

In the ink jet recording device according to the present invention, the second opening is preferably provided at an uppermost part of the liquid storage in the direction of gravity.

According to the above configuration, since all of the air in the liquid storage can be deaerated through the second opening and the second liquid ejecting passage provided at the uppermost part of the liquid storage, the inside of the liquid storage can be filled up with liquid.

Further, if dissolved gas that was dissolved in the liquid turns into bubbles after having filled up the inside of the liquid storage with the liquid, the generated gas enters into the second liquid ejecting passage from the second opening and stays in the second liquid ejecting passage, so a state in which bubbles do not exist in the liquid storage can be maintained. According to this, a function to retain negative pressure in the liquid storage is suitably prevented from being deteriorated.

The ink jet recording device according to the present invention further includes: at least one of a decompressing unit that decompresses insides of the recording head, the first liquid ejecting passage, and the second liquid ejecting passage by sucking through the nozzle, and a compression supplying unit that compresses and supplies the liquid to the liquid storage; and a filling control unit that controls the variable passage resistor, and at least one of the decompressing unit and the compression supplying unit to fill the liquid in the liquid storage, wherein the filling control unit causes at least one of decompression by the decompressing unit and compression and supply by the compression supplying unit to be performed in a state where the passage resistance in the variable passage resistor is made smaller than during normal printing.

According to the above configuration, during the liquid filling, a speed to fill the liquid can be improved by performing at least one of (i) suction from the nozzle of the recording head by the decompressing unit, and (ii) compression and supplying of the liquid to the liquid storage by the compression supplying unit.

Further, during the liquid filling, by making the passage resistance of the variable passage resistor be smaller than during the normal printing, the passage resistance of the second liquid passage is large and the bubbles in the liquid storage are not supplied to the recording head during the normal printing, whereas the passage resistance of the second liquid passage is small and the bubbles in the liquid storage can be configured to be deaerated from the recording head during the liquid filling. According to this, the normal printing and the liquid filling can be performed suitably.

In the ink jet recording device according to the present invention, the uppermost part of the first liquid ejecting passage in the direction of gravity may be convexed upward in the direction of gravity, and the second liquid ejecting passage may merge from an upper side in the direction of gravity at the uppermost part.

According to the above configuration, the dissolved gas that turned into bubbles in the first liquid ejecting passage and the recording head is deaerated into the second liquid ejecting passage from the uppermost part of the first liquid ejecting passage that is in the convexed shape, and stays in the second liquid ejecting passage. According to this, since a state in which the first liquid ejecting passage is filled with the liquid can be maintained, whereby hindrance occurring to printing by the dissolved gas can be prevented.

A liquid supplying device according to the present invention supplies liquid to a supply destination, the liquid supplying device including: a liquid storage that stores the liquid; a first liquid ejecting passage that supplies the liquid from the liquid storage to the supply destination; and a second liquid ejecting passage that supplies the liquid from the liquid storage to the supply destination by a passage different from the first liquid ejecting passage; wherein a part of the first liquid ejecting passage is arranged at a higher position in a direction of gravity than the liquid storage, the second liquid ejecting passage includes a variable passage resistor having a passage resistance which is variable, and the liquid storage includes a first opening leading to the first liquid ejecting passage, and a second opening arranged at a higher position in the direction of gravity than the first opening and leading to the second liquid ejecting passage.

According to the above configuration, at the time of filling the liquid in the liquid storage, the air in the liquid storage can be deaerated from the second liquid ejecting passage, while smoothly filling the liquid in the liquid storage and the first liquid ejecting passage.

A method of controlling an ink jet recording device, according to the present invention, wherein the ink jet recording device includes: a recording head including a nozzle that discharges liquid droplets; a liquid storage that stores liquid to be supplied to the recording head; a first liquid ejecting passage that supplies the liquid from the liquid storage to the recording head; a second liquid ejecting passage that supplies the liquid from the liquid storage to the recording head by a passage different from the first liquid ejecting passage; and a decompressing unit that decompresses insides of the recording head, the first liquid ejecting passage, and the second liquid ejecting passage by sucking through the nozzle, wherein a part of the first liquid ejecting passage is arranged at a higher position in a direction of gravity than the liquid storage, the second liquid ejecting passage includes a variable passage resistor having a passage resistance which is variable, and the liquid storage includes a first opening leading to the first liquid ejecting passage and a second opening arranged at a higher position in the direction of gravity than the first opening and leading to the second liquid ejecting passage, the method including a filling control step that fills the liquid in the liquid storage by causing the decompressing unit to perform decompression in a state where the passage resistance in the variable passage resistor is made smaller than during normal printing.

According to the above configuration, an advantageous effect similar to that of the ink jet recording device according to the present invention can be achieved.

Effects of the Invention

According to the present invention, in filling the liquid in the liquid storage, the air in the liquid storage is deaerated from the second liquid ejecting passage, while being able to smoothly fill the liquid in the liquid storage and the first liquid ejecting passage.

BRIEF DESCRIPTION OF THE DRAWINGS

FIG. 4A shows a state in which a passage resistance of the variable passage resistor is large, and FIG. 4B shows a state in which the passage resistance of the variable passage resistor is small.

EMBODIMENTS OF THE INVENTION (Ink Jet Printer)

Figure 1:
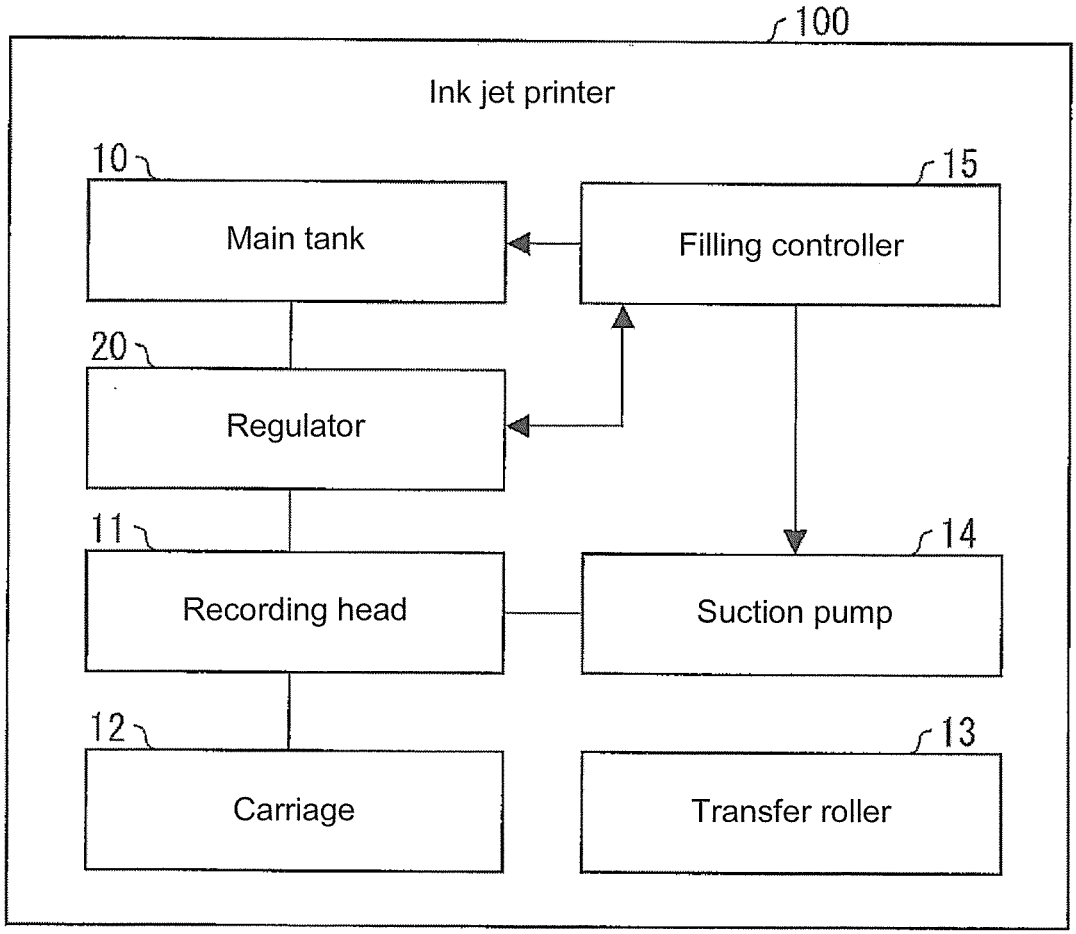
FIG. 1 is a block diagram showing a schematic configuration of an ink jet recording device according to one embodiment of the present invention.

FIG. 1 is a block diagram showing a schematic configuration of an ink jet printer (ink jet recording device) 100 according to one embodiment of the present invention.

As shown in FIG. 1, the ink jet printer 100 includes a main tank (compression supplying unit) 10, a regulator (liquid supplying device) 20, a recording head (supply destination) 11, a carriage 12, a transfer roller 13, a suction pump (decompressing unit) 14, and a filling controller (filling control unit) 15.

The main tank 10 is a container that stores ink (liquid) for printing on a desired medium. Further, the main tank 10 simply needs to be able to supply ink to the regulator 20, and no particular limitation is set thereto. However, it may be configured to compressedly send the ink to the regulator 20 (compressing and supplying) by, for example, a pump, a water head difference, and the like, as needed.

Further, the main tank 10 may be configured to be detachably attached to the ink jet printer 100.

The regulator 20 is configured to retain the ink supplied from the main tank 10 in a state of having negative pressure, and supply the ink in necessary amount to the recording head 11. The details will be described later.

The recording head 11 includes a nozzle that discharges ink liquid droplets (liquid droplets), and performs printing on the medium. It should be noted that the number of the nozzles that the recording head 11 includes is not particularly limited. The carriage 12 mounts the recording head 11, the regulator 20, and the main tank 10 thereon and moves them, for example, in a sub scanning direction. Further, the transfer roller 13 sends the print target medium, for example, in a scanning direction.

The suction pump 14 is a pump for sucking the nozzle of the recording head 11 from outside at the time of filling the ink in the regulator 20 from the outside of the recording head 11.

It should be noted that, in the present specification, a state in which the recording head 11 is performing printing is called "normal printing", and a state in which the ink is filled in the regulator 20 is called "liquid filling".

The filling controller 15 is a controller that controls the main tank 10, the regulator 20, and the suction pump 14 during liquid filling to perform the ink filling into the regulator 20. The filling controller 15 may alternately start the ink filling in accordance with a signal from the regulator 20.

It should be noted that, the ink jet printer 100 may further include a print controller (not shown) that performs desired printing by controlling the recording head 11, the carriage 12, and the transfer roller 13 during the normal printing, and an input and output unit (not shown) for performing input and output of data with an external device.

(Details of Regulator)

Figure 2:
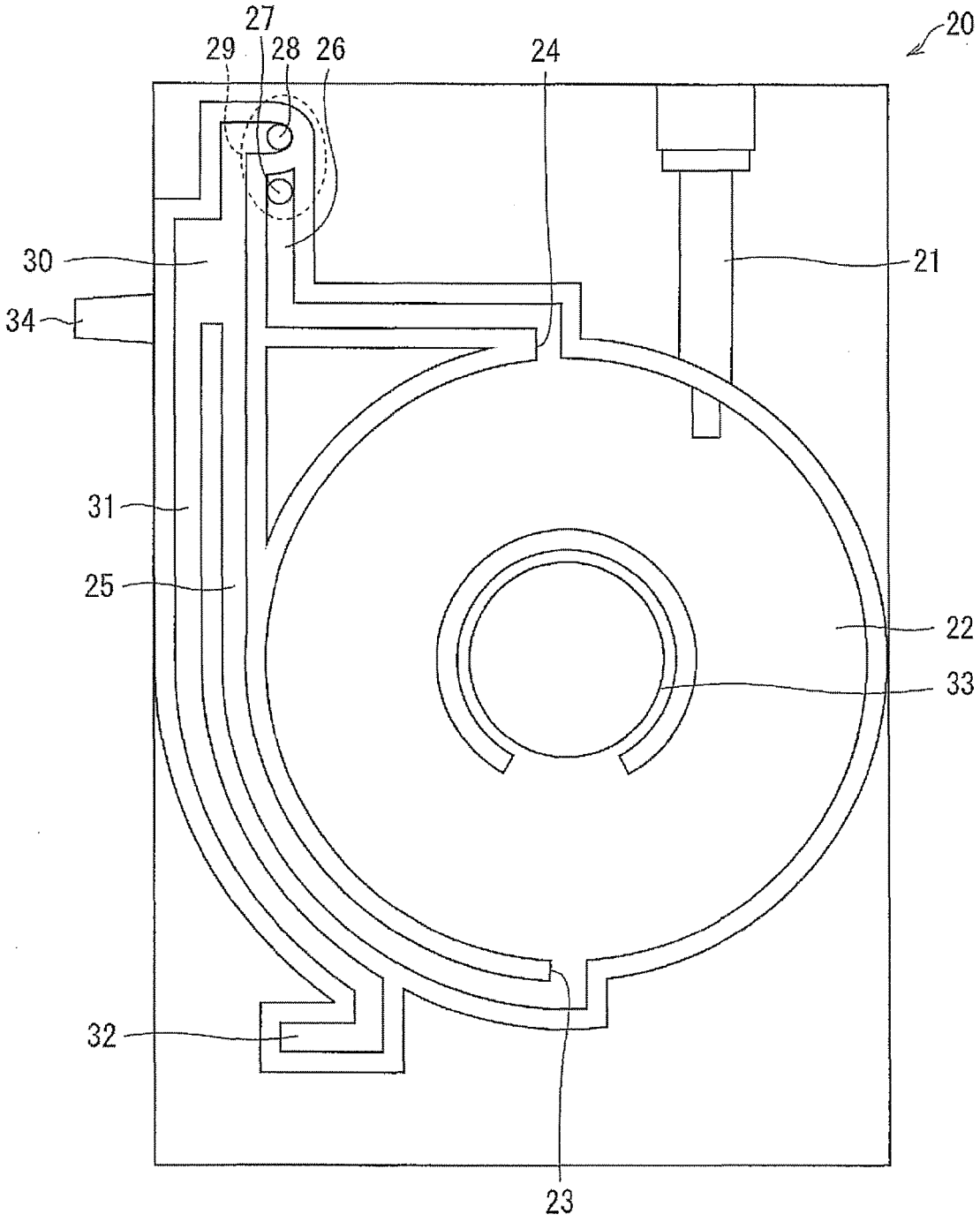
FIG. 2 is a cross sectional view showing a schematic configuration of a liquid supplying device according to one embodiment of the present invention.

FIG. 2 is a cross sectional view showing a schematic configuration of the regulator 20. Further, FIG. 3 is a top view of the regulator 20.

Figure 3:
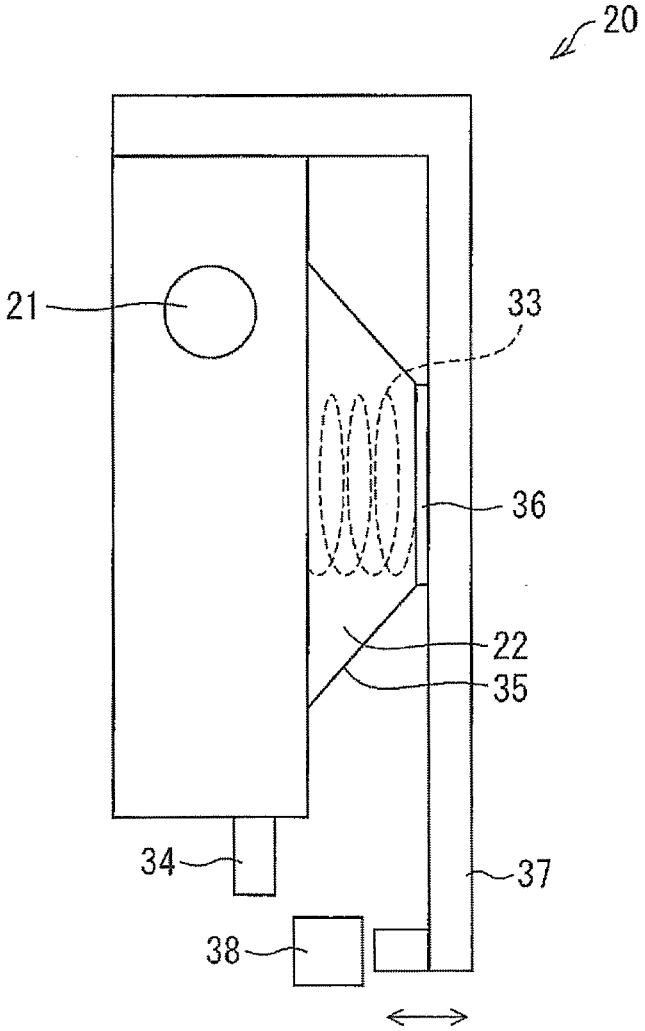
FIG. 3 is a top view of the liquid supplying device according to one embodiment of the present invention.

As shown in FIG. 2 and FIG. 3, the regulator 20 includes a supply port 21, a liquid storage 22, a passage (first liquid ejecting passage) 25, a passage (second liquid ejecting passage) 26, a variable passage resistor 29, a merging part (uppermost part of the first liquid ejecting passage) 30, a passage (first liquid ejecting passage and second liquid ejecting passage) 31, a connecting part 32, a spring 33, a circulation port 34, a film 35, a resin member 36, a sensor light shielding arm 37 and a sensor 38.

The supply port 21 communicates with the main tank 10, and the ink supplied from the main tank 10 during the liquid filling is introduced into the liquid storage 22 from the supply port 21.

The liquid storage 22 is a space for storing the ink to be supplied to the recording head 11 in a state having negative pressure, and one of side surfaces of the space is covered by the film 35 having a stretching property. Further, the film 35 is biased in a direction expanding the space by the spring 33 arranged in the liquid storage 22, whereby the liquid storage 22 is maintained to have the negative pressure on its inside.

The liquid storage 22 has an opening (first opening) 23 leading to the passage 25 and an opening (second opening) 24 leading to the passage 26. Preferably, as shown in FIG. 2, the opening 24 may be provided at an uppermost part of the liquid storage 22 in a direction of gravity. However, no limitation is made hereto, and the opening 24 will suffice so long as it is provided at a higher position than the opening 23 in the direction of gravity. Further, preferably, as shown in FIG. 2, the opening 23 may be provided at a lowermost part of the liquid storage 22 in the direction of gravity, but no limitation is made hereto.

The passage 25, the passage 26, the merging part 30, the passage 31, and the connecting part 32 configure a passage to supply the ink from the liquid storage 22 to the recording head 11, and the passages 25 and 26 communicating with the liquid storage 22 merge at the merging part 30 and communicate with the connecting part 32 communicating with the recording head 11 through the passage 31. Further, the passage 25, the merging part 30, the passage 31, and the connecting part 32 configure the first liquid ejecting passage that supplies the ink from the liquid storage 22 to the recording head 11, and the passage 26, the merging part 30, the passage 31, and the connecting part 32 configure the second liquid ejecting passage that supplies the ink from the liquid storage 22 to the recording head 11 through a passage different from the first liquid ejecting passage.

Here, a part of the first liquid ejecting passage is arranged at a higher position than the liquid storage 22 in the direction of gravity. For example, in the present embodiment, the merging part 30 is arranged at a higher position than the liquid storage 22 in the direction of gravity, but no limitation is made hereto.

Further, the passage 26 includes a variable passage resistor 29 that enables passage resistance to be variable on a passage thereof. A configuration of the variable passage resistor 29 is not particularly limited so long as it enables the passage resistance to be variable, and a publicly known technique can be used; for example, a configuration shown in FIG. 4A and FIG. 4B can be used.

Figure 4A:
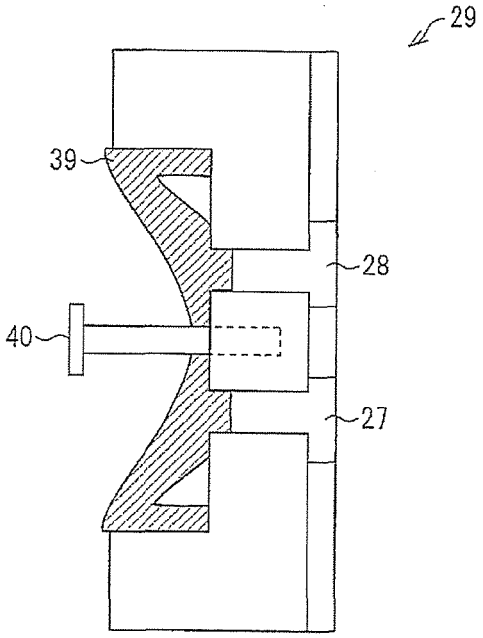
FIG. 4A and FIG. 4B are cross sectional views illustrating an operation of a variable passage resistor of one embodiment of the present invention, where
Figure 4B:
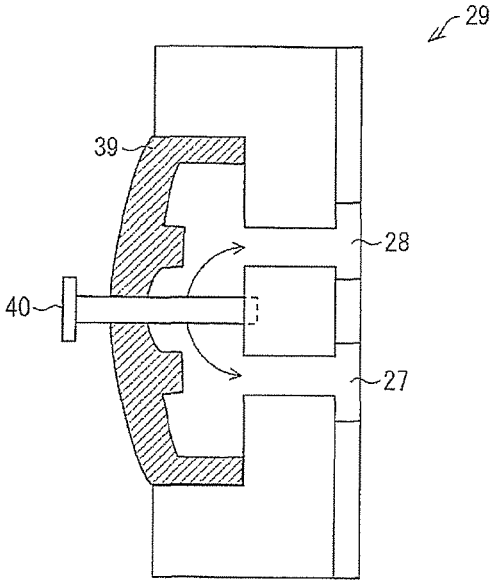

FIG. 4A and FIG. 4B are cross sectional views illustrating an operation of the variable passage resistor 29, where FIG. 4A shows a state in which a passage resistance of the variable passage resistor 29 is large, and FIG. 4B shows a state in which the passage resistance of the variable passage resistor 29 is small.

As shown in FIG. 4A and FIG. 4B, the variable passage resistor 29 includes a port 27, a port 28, a rubber packing 39, and a switching pin 40. The port 27 communicates with a liquid storage 22 side of the passage 26, and the port 28 communicates with a merging part 30 side of the passage 26.

In the state where the passage resistance is large, as shown in FIG. 4A, the rubber packing 39 shuts off the passage between the port 27 and the port 28. On the other hand, in the state where the passage resistance is small, as shown in FIG. 4B, the rubber packing 39 does not shut off the passage between the port 27 and the port 28. Deformation of the rubber packing 39 is performed by the switching pin 40. The switching pin 40 is not particularly limited. However, it may be operated, for example, by an actuator (not shown) and controlled by the filling controller 15.

It should be noted that, the filling controller 15 controls the variable passage resistor 29 to be in the state of FIG. 4A during the normal printing, and controls the same to be in the state of FIG. 4B during the liquid filling. It should be noted that, in another embodiment, the variable passage resistor 29 may be operated manually, and it may be operated manually to be in the state of FIG. 4A during the normal printing, and may be operated manually to be in the state of FIG. 4B during the liquid filling.

Further, as shown in FIG. 2, preferably, the merging part 30 is at the uppermost part of the first liquid ejecting passage (passage 25, merging part 30, passage 31, and connecting part 32) in the direction of gravity, where the first liquid ejecting passage is convexed upward at the merging part 30 in the direction of gravity, and the merging part 30 has the second liquid ejecting passage (passage 26, merging part 30, passage 31, and connecting part 32) merging from upper side in the direction of gravity. Further, an area of the passage at the merging part 30 is preferably wider than a passage area of any of the respective passages (passage 25, passage 26, and passage 31) communicating with the merging part 30.

Here, the liquid storage 22 expands by a balance between the negative pressure according to an amount of the ink stored in the liquid storage 22 and the biasing force of the spring 33. That is, the liquid storage 22 is in its most expanded state when the liquid storage 22 is filled up with the ink, and the liquid storage 22 is in its most shrunk state when the ink is lost from within the liquid storage 22.

Figure 5:
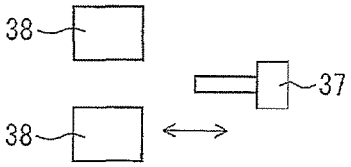
FIG. 5 is a front view illustrating an operation of a sensor of one embodiment of the present invention.

A sensor light shielding arm 37 is arranged at one external side of the liquid storage 22, and is configured to be movable according to expansion and shrinking of the liquid storage 22. Further, the amount of the ink within the liquid storage 22 can be detected by the sensor 38 detecting the movement of the sensor light shielding arm 37. The sensor 38 is for example an optical distance sensor having a configuration as shown in FIG. 5 and detects the movement of the sensor light shielding arm 37. It should be noted that a type of the sensor 38 is not particularly limited and it may be able to directly measure displacement of the film 35 without detecting the movement of the sensor light shielding arm 37.

A detection result of the sensor 38 is sent to the filling controller 15, and the filling controller 15 starts liquid filling operation by controlling the main tank 10, the regulator 20, and the suction pump 14 when the amount of the ink in the liquid storage 22 becomes equal to or less than a threshold. That is, the ink is compressedly sent from the main tank 10 to the regulator 20, and the recording head 11 is sucked by the suction pump 14. The details of the control of the regulator 20 will be described later.

It should be noted that, the resin member 36 is provided between the film 35 and the sensor light shielding arm 37, and the film 35 is prevented from being damaged by the sensor light shielding arm 37.

Further, the circulation port 34 is a member for circulating the ink in the regulator 20, and is a suction port of the ink communicating with the first liquid ejecting passage. In case of using ink that is not easily homogenized such as white pigmented ink, the ink can be circulated by sucking the ink from the circulation port 34 and returning the sucked ink into the liquid storage 22 from the supply port 21 during the normal printing or at other times, whereby sedimentation of pigments can be prevented, and homogenization can be obtained.

(Operation During Liquid Filling)

Next, the operation of the regulator 20 during the liquid filling will be described in detail with reference to FIGS. 6 to 8. It should be noted that, as described above, in the present embodiment, during the liquid filling, a state is assumed in which the ink is compressedly sent from the main tank 10 through the supply port 21 to the regulator 20 and the ink is sucked by the recording head 11 through the connecting part 32 by the control by the filling controller 15. It should be noted that, the compressed feeding of ink from the main tank 10 and the suction of the recording head 11 are not necessarily required. However, the ink can be filled up faster by performing these processes. That is, the ink jet printer 100 may be configured not to have either (i) the compression supplying unit that performs compressed feeding of ink from the main tank 10 or (ii) the decompressing unit that sucks the nozzle of the recording head 11. However, it is preferable to be in a configuration having at least one of them.

Further, in the present embodiment, during the liquid filling, the filling controller 15 controls to assume the state in which the passage resistance of the variable passage resistor 29 is small (state shown in FIG. 4B).

Figure 6:
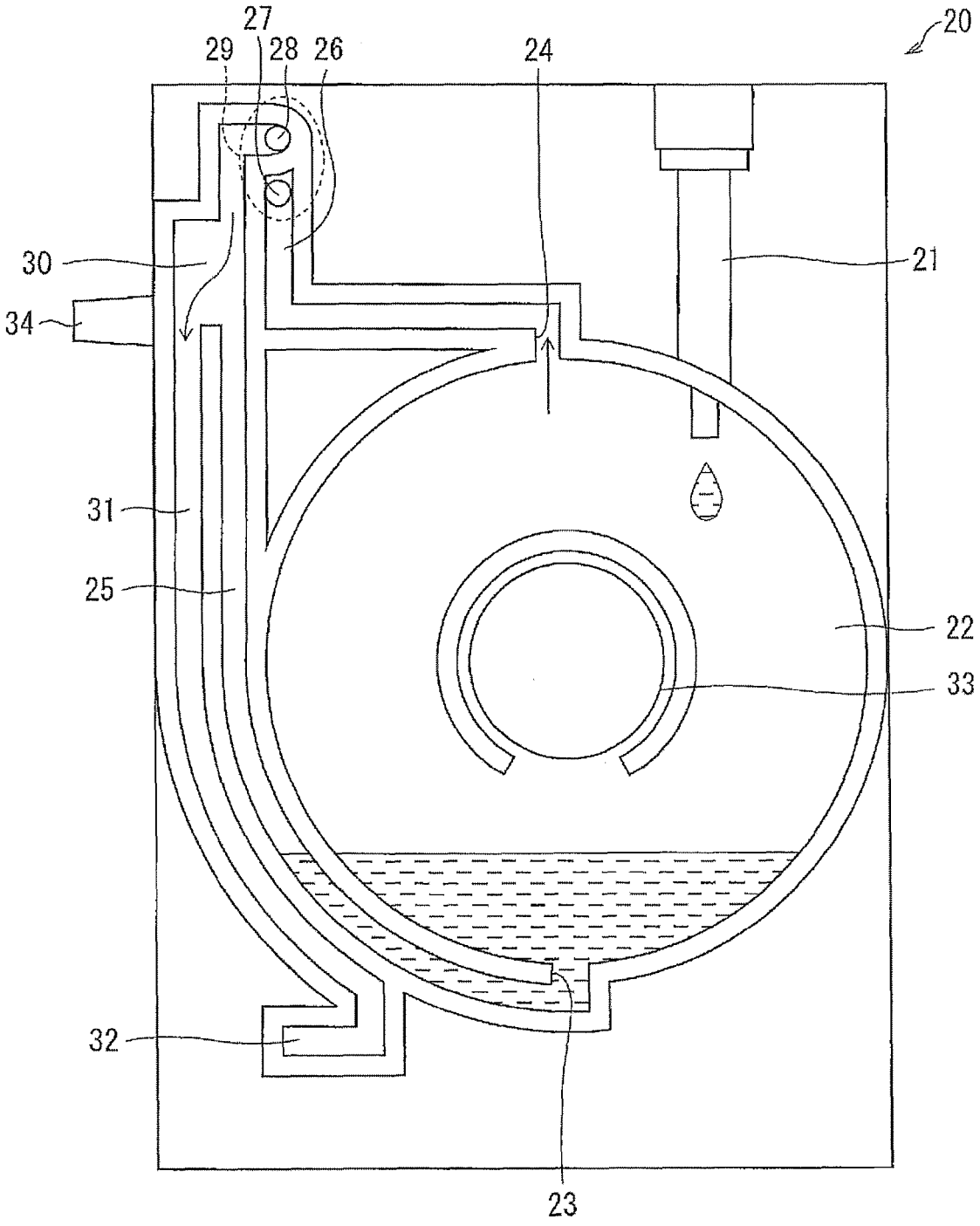
FIG. 6 is a cross sectional view showing a state where liquid is filled by a liquid supplying device according to one embodiment of the present invention.

FIG. 6 illustrates a state of the regulator 20 at an initial stage of the liquid filling. As shown in FIG. 6, at the initial stage of the liquid filling, the ink supplied from the supply port 21 is stored in the liquid storage 22 and the passage 25, and together with this, the air in the liquid storage 22, the passage 25, the passage 26, the merging part 30, and the passage 31 is sucked from the connecting part 32.

Figure 7:
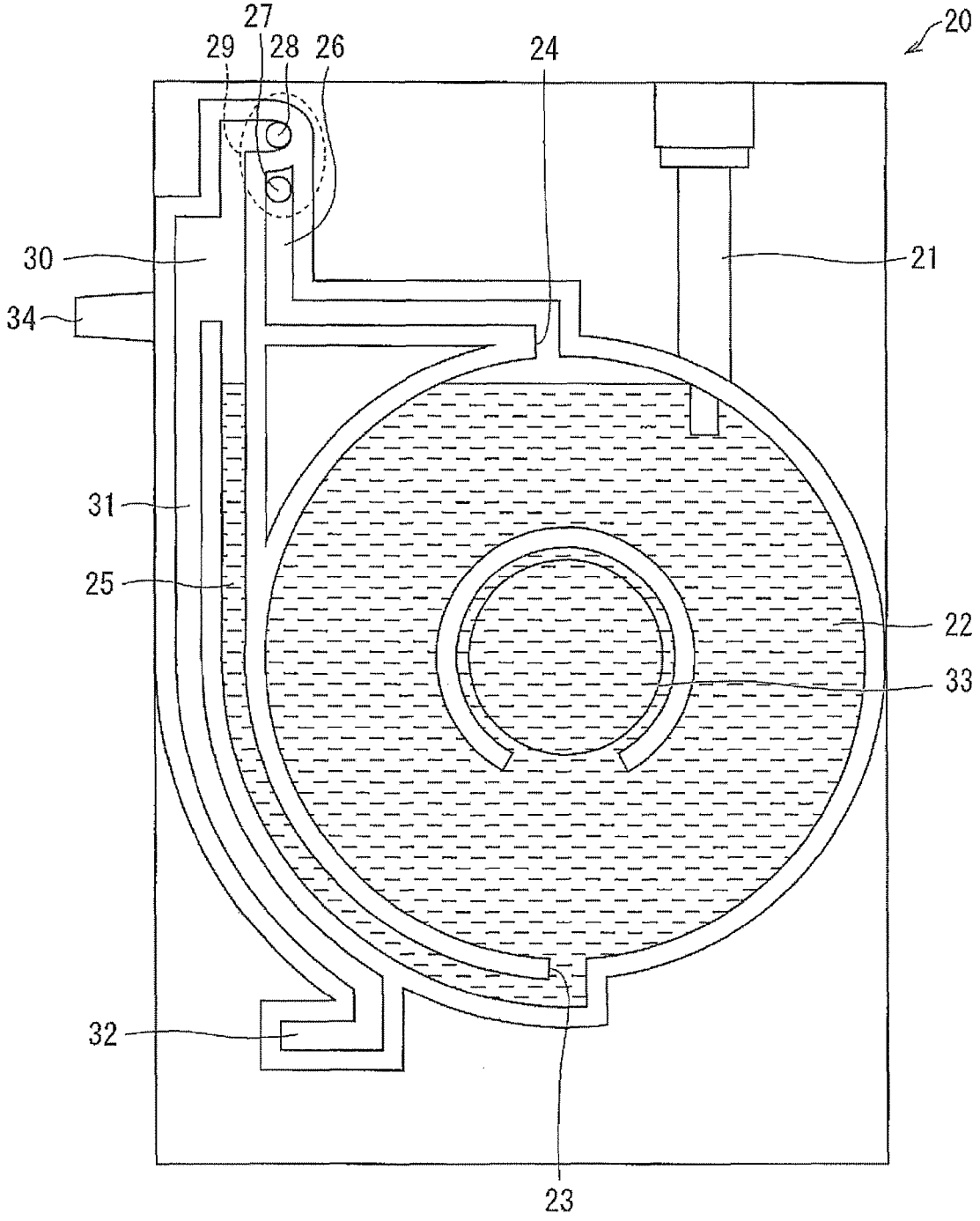
FIG. 7 is a cross sectional view showing a state where the liquid is filled by the liquid supplying device according to one embodiment of the present invention.

FIG. 7 illustrates a state of the regulator 20 at an intermediate stage of the liquid filling. As shown in FIG. 7, even in the intermediate stage of the liquid filling, the ink supplied from the supply port 21 is stored in the liquid storage 22 and the passage 25, and together with this, the air in the liquid storage 22, the passage 25, the passage 26, the merging part 30, and the passage 31 is sucked from the connecting part 32.

It should be noted that, since the merging part 30 is positioned at the higher position than the liquid storage 22, the ink in the passage 25 will not flow into the connecting part 32 even in the intermediate stage. Further, with the opening 24 being arranged at the higher position than the opening 23 (especially, at the uppermost part of the liquid storage 22), only the air in the liquid storage 22 is deaerated from the opening 24 even in the intermediate stage. Due to this, even in the intermediate stage, only the air can be discharged to the recording head 11.

Figure 8:
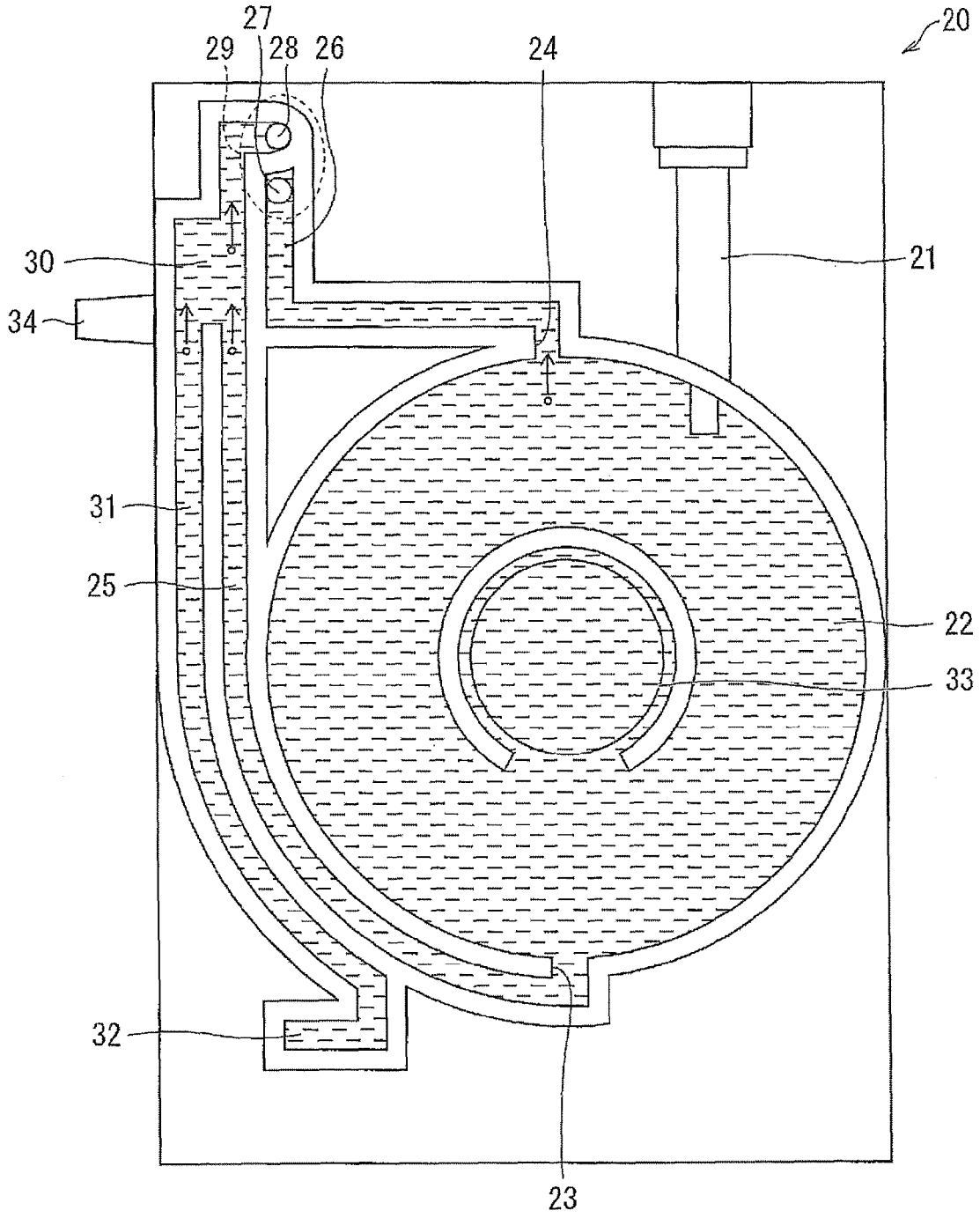
FIG. 8 is a cross sectional view showing a state where liquid is filled by a liquid supplying device according to one embodiment of the present invention.

FIG. 8 illustrates a state of the regulator 20 at a late stage of the liquid filling. As shown in FIG. 8, in the late stage of the liquid filling, the ink supplied from the supply port 21 is stored in the liquid storage 22, the passage 25, the passage 26, the merging part 30, and the passage 31.

According to the above, the ink can be filled in the regulator 20. Here, as mentioned above, the opening 24 in the liquid storage 22 leading to the second liquid ejecting passage is arranged at the higher position than the opening 23 leading to the first liquid ejecting passage, whereby the air in the liquid storage 22 can be deaerated through the second liquid ejecting passage, and at the same time the liquid can be filled in the liquid storage 22 and the first liquid ejecting passage.

It should be noted that, the opening 24 can deaerate all of the air in the liquid storage 22 through the opening 24 and the second liquid ejecting passage by being at the uppermost part of the liquid storage 22. According to this, the liquid storage 22 can be filled up with the ink. However, the opening 24 does not need to be provided at the uppermost part of the liquid storage 22, and just needs to be provided at a higher position than the opening 23. Even in this case, at least the air at a lower position than the opening 24 in the liquid storage 22 in the direction of gravity can suitably be deaerated through the second liquid ejecting passage.

Further, due to the passage area of the merging part 30 being larger than any of the passage areas of the respective passages (passage 25, passage 26, and passage 31) communicating with the merging part 30, the air having flowed in from the passage 26 can be deaerated from the passage 31, even in a state where the ink is flowing into the merging part 30 from the passage 25. According to this, the air can suitably be deaerated from the liquid storage 22.

Further, by a part (merging part 30) of the first liquid ejecting passage being arranged at the higher position than the liquid storage 22 in the direction of gravity, a circumstance in which only the ink is taken out through the first liquid ejecting passage before the air in the liquid storage 22 is sufficiently deaerated through the second liquid ejecting passage can be avoided. According to this, the ink can be smoothly filled in the liquid storage 22.

Further, in FIG. 8, a case where the dissolved gas that was dissolved in the ink turns into bubbles after having filled up the liquid storage 22 with ink is also described. As shown in FIG. 8, the bubbles generated in the liquid storage 22 enter into the passage 26 from the opening 24 and stay in the passage 26. Therefore, a state in which no bubbles are present in the liquid storage 22 can be maintained. According to this, a negative pressure retaining function in the liquid storage 22 can suitably be prevented from being deteriorated. Especially, when the opening 24 is at the uppermost part of the liquid storage 22, the bubbles can suitably be guided to the opening 24.

Further, the dissolved gas that had turned into bubbles in the passage 25, the passage 31, and the recording head 11 is discharged to the passage 26 through the merging part 30, and stays in the passage 26. According to this, since the state in which the passage 25 and the passage 31 are filled up with the ink can be maintained, defects occurring in printing by the dissolved gas can be prevented.

Further, after filling the ink in the liquid storage 22, the ink supply from the main tank 10 is stopped, and the negative pressure can be formed in the liquid storage 22 by discharging the ink from the recording head 11. Further, in other embodiments, an ink refluxing unit may be provided to cause reflux of the ink toward an upstream (main tank 10) from the liquid storage 22 in order to form the negative pressure in the liquid storage 22.

During the nominal printing, the recording head 11 discharges the ink supplied from the liquid storage 22 as ink liquid droplets. When the ink in the liquid storage 22 decreases by printing, the sensor light shielding arm 37 is displaced as described above, and this is detected by the sensor 38. The filling controller 15 is configured to start the liquid filling again based on the detection result of the sensor 38 when the amount of the ink in the liquid storage 22 has become equal to or less than the predetermined threshold.

It should be noted that, in a case that the opening 23 is at the lowermost part of the liquid storage 22, the ink can be supplied instead of air to the recording head 11 so long as there is ink remaining in the liquid storage 22, which is preferable for continuing printing.

Further, by making the passage resistance of the variable passage resistor 29 be different between the liquid filling and the normal printing, the passage resistance of the second liquid ejecting passage is large and the bubbles in the liquid storage 22 are not supplied to the recording head 11 during the normal printing, whereas the passage resistance of the second liquid ejecting passage is small and the bubbles in the liquid storage 22 can be configured to be deaerated from the recording head 11 during the liquid filling. According to this, the normal printing and the liquid filling can be performed suitably.

It should be noted that, the regulator 20 according to the present embodiment is not necessarily limited to the configuration of being installed in the ink jet printer 100, and it may be configured as a liquid supplying device that supplies liquid to a supply destination of some sort requiring liquid supply.

<Supplemental Information>

The ink jet printer (ink jet recording device) 100 includes: the recording head 11 including the nozzle that discharges the liquid droplets; the liquid storage 22 that stores the ink (liquid) to be supplied to the recording head 11; the first liquid ejecting passage (passage 25, merging part 30, passage 31, and connecting part 32) that supplies the ink from the liquid storage 22 to the recording head 11; and the second liquid ejecting passage (passage 26, merging part 30, passage 31, and connecting part 32) that supplies the ink from the liquid storage 22 to the recording head 11 by a passage different from the first liquid ejecting passage; wherein a part of the first liquid ejecting passage is arranged at the higher position in the direction of gravity than the liquid storage 22, the second liquid ejecting passage includes the variable passage resistor 29 having a passage resistance which is variable, and the liquid storage 22 includes the opening (first opening) 23 leading to the first liquid ejecting passage, and the opening (second opening) 24 arranged at the higher position in the direction of gravity than the opening 23 and leading to the second liquid ejecting passage.

According to the above configuration, in the liquid storage 22, the opening 24 leading to the second liquid ejecting passage is arranged at the higher position than the opening 23 leading to the first liquid ejecting passage.

Due to this, at the time of filling the ink in the liquid storage 22, air in the liquid storage 22 can be deaerated through the second liquid ejecting passage while filling the ink in the liquid storage 22 and the first liquid ejecting passage.

Further, since a part of the first liquid ejecting passage is arranged at the higher position than the liquid storage 22, a circumstance in which only the ink is taken out through the first liquid ejecting passage before the air in the liquid storage 22 is deaerated through the second liquid ejecting passage can be avoided.

According to this, the ink can be smoothly filled in the liquid storage 22.

In the ink jet printer 100, the opening 24 is provided at the uppermost part of the liquid storage 22 in the direction of gravity.

According to the above configuration, since all of the air in the liquid storage 22 can be deaerated through the opening 24 and the second liquid ejecting passage provided at the uppermost part of the liquid storage 22, the inside of the liquid storage 22 can be filled up with ink.

It is preferable that the ink jet printer 100 includes at least one of the suction pump (decompressing unit) 14 that decompresses insides of the recording head 11, the first liquid ejecting passage, and the second liquid ejecting passage by sucking through the nozzle, and the main tank (compression supplying unit) 10 that compresses and supplies the ink (liquid) to the liquid storage 22; and the filling controller (filling control unit) 15 that controls the variable passage resistor 29 and at least one of the suction pump 14 and the main tank 10 to fill the ink in the liquid storage 22, wherein the filling controller 15 causes at least one of decompression by the suction pump 14 and compression and supply by the main tank 10 to be performed in the state where the passage resistance in the variable passage resistor 29 is made smaller than during the normal printing.

According to the above configuration, during the liquid filling, the speed to fill the ink can be improved by performing at least one of the suction from the nozzle of the recording head 11 by the suction pump 14, and the compression and supplying of the ink to the liquid storage 22 by the main tank 10.

Further, during the liquid filling, by making the passage resistance of the variable passage resistor 29 be smaller than during the normal printing, the passage resistance of the second liquid ejecting passage is large and the bubbles in the liquid storage 22 are not supplied to the recording head 11 during the normal printing, whereas the passage resistance of the second liquid ejecting passage is small and the bubbles in the liquid storage 22 can be configured to be deaerated from the recording head 11 during the liquid filling. According to this, the normal printing and the liquid filling can be performed suitably.

In the ink jet printer 100, the uppermost part of the first liquid ejecting passage in the direction of gravity may be convexed upward in the direction of gravity, and the second liquid ejecting passage may merge from the upper side in the direction of gravity at the uppermost part.

According to the above configuration, the dissolved gas that turned into bubbles in the first liquid ejecting passage (especially in passage 25 and passage 31) and the recording head 11 is deaerated into the passage 26 of the second liquid ejecting passage from the uppermost part (merging part 30) of the first liquid ejecting passage that is in the convexed shape, and stays in the passage 26. According to this, since the state in which the first liquid ejecting passage (especially passage 25 and passage 31) is filled up with the ink can be maintained, defects occurring in printing by the dissolved gas can be prevented.

The passage 20 is a liquid supplying device that supplies the ink (liquid) to the recording head (supply destination) 11, and includes the liquid storage 22 that stores the ink; the first liquid ejecting passage (passage 25, merging part 30, passage 31, and connecting part 32) that supplies the ink from the liquid storage 22 to the recording head 11; and the second liquid ejecting passage (passage 26, merging part 30, passage 31, and connecting part 32) that supplies the ink from the liquid storage 22 to the recording head 11 by a passage different from the first liquid ejecting passage; wherein a part of the first liquid ejecting passage is arranged at the higher position in the direction of gravity than the liquid storage 22, the second liquid ejecting passage includes the variable passage resistor 29 having a passage resistance which is variable, and the liquid storage 22 includes the opening (first opening) 23 leading to the first liquid ejecting passage, and the opening (second opening) 24 arranged at the higher position in the direction of gravity than the opening 23 and leading to the second liquid ejecting passage.

According to the above configuration, at the time of filling the ink in the liquid storage 22, the air in the liquid storage 22 can be deaerated from the second liquid ejecting passage, while smoothly filling the ink in the liquid storage 22 and the first liquid ejecting passage.

In the method of controlling the ink jet printer, the ink jet printer 100 includes: the recording head 11 including the nozzle that discharges the liquid droplets; the liquid storage 22 that stores the liquid to be supplied to the recording head 11; the first liquid ejecting passage (passage 25, merging part 30, passage 31, and connecting part 32) that supplies the ink from the liquid storage 22 to the recording head 11; the second liquid ejecting passage (passage 26, merging part 30, passage 31, and connecting part 32) that supplies the ink from the liquid storage 22 to the recording head 11 by a passage different from the first liquid ejecting passage; and the suction pump (decompressing unit) 14 that decompresses the insides of the recording head 11, the first liquid ejecting passage, and the second liquid ejecting passage by sucking through the nozzle, wherein a part of the first liquid ejecting passage is arranged at the higher position in the direction of gravity than the liquid storage 22, the second liquid ejecting passage includes the variable passage resistor 29 having a passage resistance which is variable, and the liquid storage 22 includes the opening (first opening) 23 leading to the first liquid ejecting passage and the opening (second opening) 24 arranged at the higher position in the direction of gravity than the opening 23 and leading to the second liquid ejecting passage, the method including a filling control step that fills the ink in the liquid storage 22 by causing the suction pump 14 to perform decompression in the state where the passage resistance in the variable passage resistor 29 is made smaller than during the normal printing.

According to the above configuration, an advantageous effect similar to that of the ink jet printer 100 can be achieved.

The present invention is not limited to the above described embodiments, and various modifications can be made within the scope defined by the claims; and embodiments obtained by suitably combining the technical features disclosed in the respective embodiments are also included within the technical scope of the present invention.

INDUSTRIAL APPLICABILITY

The present invention can be used in a field of manufacturing a device provided with a liquid supplying mechanism (for example, ink jet recording device).

The invention claimed is:

1. An ink jet recording device, comprising:

a recording head including a nozzle that discharges liquid droplets;

a liquid storage that stores liquid to be supplied to the recording head;

a first liquid ejecting passage that supplies the liquid from the liquid storage to the recording head; and a discharge passage, different from the first liquid ejecting passage, and the discharge passage discharge an air from the liquid storage during liquid filling toward the liquid storage;

the liquid storage is used in a state in which the liquid is supplied to the recording head and the liquid storage is totally filled with the liquid;

the liquid storage includes a first opening leading to the first liquid ejecting passage, and a second opening arranged at a higher position in the direction of gravity than the first opening and leading to the discharge passage;

the second opening is provided at an uppermost part of the liquid storage in the direction of gravity;

a part of the first liquid ejecting passage is arranged at a higher position in the direction of gravity than the second opening;

in a way of the first liquid ejecting passage, a first height position which is an uppermost position in the direction of gravity is provided, and the first height position is disposed at a position higher than the second opening;

the discharge passage is merged with the first liquid ejecting passage at the first height position.

2. The ink jet recording device according to claim 1, further comprising:

at least one of a decompressing unit that decompresses insides of the recording head and the first liquid ejecting passage by sucking through the nozzle, and a compression supplying unit that compresses and supplies the liquid to the liquid storage; and a filling control unit that controls at least one of the decompressing unit and the compression supplying unit to fill the liquid in the liquid storage, wherein the filling control unit causes at least one of decompression by the decompressing unit and compression and supply by the compression supplying unit to be performed.

3. The ink jet recording device according to claim 1, wherein at the uppermost part of the first liquid ejecting passage, the discharge passage merges from an upper side in the direction of gravity toward the first liquid ejecting passage.

4. A liquid supplying device that supplies liquid to a supply destination, and the liquid supplying device comprising:

a liquid storage that stores the liquid;

a first liquid ejecting passage that supplies the liquid from the liquid storage to the supply destination; and a discharge passage, different from the first liquid ejecting passage, and the discharge passage discharge an air from the liquid storage during ink filling toward the liquid storage;

the liquid storage is used in a state in which the liquid is supplied to a recording head and the liquid storage is totally filled with the liquid;

the liquid storage includes a first opening leading to the first liquid ejecting passage, and a second opening arranged at a higher position in the direction of gravity than the first opening and leading to the discharge passage;

a part of the first liquid ejecting passage is arranged at a higher position in the direction of gravity than the second opening;

in a way of the first liquid ejecting passage, a first height position which is an uppermost position in the direction of gravity is provided, and the first height position is disposed at a position higher than the second opening;

the discharge passage is merged with the first liquid ejecting passage at the first height position.

5. A method of controlling an ink jet recording device, wherein the ink jet recording device includes: a recording head including a nozzle that discharges liquid droplets; a liquid storage that stores liquid to be supplied to the recording head; a first liquid ejecting passage that supplies the liquid from the liquid storage to the recording head; a second liquid ejecting passage that supplies the liquid from the liquid storage to the recording head by a passage different from the first liquid ejecting passage; and a decompressing unit that decompresses insides of the recording head, the first liquid ejecting passage, and the second liquid ejecting passage by sucking through the nozzle, a part of the first liquid ejecting passage is arranged at a higher position in a direction of gravity than the liquid storage, the second liquid ejecting passage includes a variable passage resistor having a passage resistance which is variable, and the liquid storage includes a first opening leading to the first liquid ejecting passage and a second opening arranged at a higher position in the direction of gravity than the first opening and leading to the second liquid ejecting passage, and the method of controlling an ink jet recording device comprising:

a filling control step that fills the liquid in the liquid storage by causing the decompressing unit to perform decompression in a state where the passage resistance in the variable passage resistor is made smaller than during normal printing.

6. The ink jet recording device according to claim 2, wherein at the uppermost part of the first liquid ejecting passage, the discharge passage merges from an upper side in the direction of gravity toward the first liquid ejecting passage.

7. The ink jet recording device according to claim 1, wherein in a way of the first liquid ejecting passage, a first height position which is an uppermost position in the direction of gravity is provided, and the first height position is disposed at a position higher than the second opening;

in a way of the discharge passage, a second height position which is a position higher than the first height position in the direction of gravity is provided.

* * * * *